US011525630B2

(12) United States Patent
Jung

(10) Patent No.: US 11,525,630 B2
(45) Date of Patent: Dec. 13, 2022

(54) UMBRELLA WATER REMOVING APPARATUS

(71) Applicant: MORRIS&CO CO., LTD., Chungcheongbuk-do (KR)

(72) Inventor: Tae Bong Jung, Seoul (KR)

(73) Assignee: MORRIS&CO CO., LTD., Chungcheongbuk-Do (KR)

( * ) Notice: Subject to any disclaimer, the term of this patent is extended or adjusted under 35 U.S.C. 154(b) by 0 days.

(21) Appl. No.: 16/760,157

(22) PCT Filed: Oct. 15, 2019

(86) PCT No.: PCT/KR2019/013533
§ 371 (c)(1),
(2) Date: Apr. 29, 2020

(87) PCT Pub. No.: WO2020/166783
PCT Pub. Date: Aug. 20, 2020

(65) Prior Publication Data

US 2021/0364234 A1 Nov. 25, 2021

(30) Foreign Application Priority Data

Feb. 12, 2019 (KR) ..... 10-2019-0015838
Jul. 17, 2019 (KR) ..... 10-2019-0086263

(51) Int. Cl.
*F26B 5/14* (2006.01)
*A47G 25/12* (2006.01)
*F26B 5/16* (2006.01)

(52) U.S. Cl.
CPC ..... *F26B 5/14* (2013.01); *A47G 25/12* (2013.01); *F26B 5/16* (2013.01); *F26B 2210/10* (2013.01)

(58) Field of Classification Search
CPC ..... F26B 5/14; F26B 5/16; F26B 2210/10; A47G 25/12; A45B 2025/003; A45B 25/28
See application file for complete search history.

(56) References Cited

FOREIGN PATENT DOCUMENTS

| | | | | |
|---|---|---|---|---|
| CN | 104075542 | A | * | 10/2014 |
| JP | H0591916 | A | | 4/1993 |
| JP | 2009063284 | A | | 3/2009 |
| JP | 4942437 | B2 | | 5/2012 |
| JP | 5317303 | B2 | | 10/2013 |
| JP | 6616746 | B2 | | 12/2019 |
| KR | 200341570 | Y1 | | 2/2004 |
| KR | 100634840 | B1 | * | 10/2006 |
| KR | 20120096750 | A | * | 8/2012 |
| KR | 10-2015-0016837 | A | | 2/2015 |
| KR | 10-1526260 | B1 | | 6/2015 |
| KR | 10-2018-0032212 | A | | 3/2018 |

* cited by examiner

*Primary Examiner* — Jessica Yuen
(74) *Attorney, Agent, or Firm* — LRK Patent Law Firm

(57) ABSTRACT

An umbrella water removing apparatus for collecting and draining rainwater on a wet umbrella includes: a supporting part; plate-shaped first and second dewatering parts provided on an upper surface the supporting part at positions spaced apart from each other at a regular interval; a detachable pad attached and fixed to an inner surface of each of the first and second dewatering parts; a dewatering space formed between the respective detachable pads fixed to the respective inner surfaces of the first and second dewatering parts; and a plurality of protruding parts protruding from each of the detachable pads toward the dewatering space along a vertical direction.

14 Claims, 10 Drawing Sheets

UMBRELLA WATER REMOVING APPARATUS

CROSS-REFERENCE TO RELATED APPLICATIONS

The present application is a U.S. National Phase entry from International Application No. PCT/KR2019/013533, filed Oct. 15, 2019, which claims priority to Korean Patent Application Nos. 10-2019-0015838, filed Feb. 12, 2019, and 10-2019-0086263, filed Jul. 17, 2019, the disclosures of which are incorporated by reference herein in their entirety.

BACKGROUND

1. Technical Field

The present invention relates generally to an umbrella water removing apparatus and, more particularly, to an umbrella water removing apparatus that efficiently removes rainwater from a wet umbrella.

2. Description of Related Art

In general, umbrellas are used as a means to avoid rain. If people enter department stores, discount stores, or office buildings with wet umbrellas, rainwater on the umbrellas will fall onto the floor and pollute the indoor environment. Furthermore, there is a risk of rainwater on the floor causing inconvenience to people walking on a wet floor, and the wet floor causing a person to slip and fall.

Recently, plastic bag dispensers for wet umbrellas have been used at the entrances of buildings, and the like. However, used plastic bags may not be recycled, but rather discarded as garbage, leading to problems of a waste of resources and pollution of the environment. Furthermore, the plastic bag dispensers are costly, plastic bags need to be refilled frequently, and it is difficult to use the dispensers due to frequent failures.

In an effort to solve the above problems, the Applicant of the present application has filed application in Korean Patent Application Publication No. 10-2018-0032212, entitled "Water wiping apparatus". This technique in the related art is a technique in which rainwater is removed as a wet umbrella passing between first and second bodies opposed to each other comes into contact with a plurality of protrusions of the first and second bodies.

However, the technique in the related art is problematic that rainwater cannot be removed efficiently because the wet umbrella is simply rubbed against the protrusions of the first and second bodies.

Furthermore, it is also problematic that rainwater of a next umbrella cannot be removed properly because the protrusions of the first and second bodies still retain rainwater previously adsorbed.

Furthermore, it is still problematic that the areas in front of and behind the water wiping apparatus may become dirty due to rainwater falling onto the floor in a large amount from an umbrella approaching or leaving the apparatus.

SUMMARY

Accordingly, the present invention has been made keeping in mind the above problems occurring in the related art, and an objective of the present invention is to provide an umbrella water removing apparatus, wherein by providing protruding parts at a detachable pad, rainwater on an umbrella is efficiently shaken off while the wet umbrella vibrates, and at the same time, also rainwater adsorbed on the protruding parts is efficiently shaken off and falls down by vibration of the protruding parts.

Another objective of the present invention is to provide an umbrella water removing apparatus, wherein by providing numerous protrusions at protruding parts and by providing numerous auxiliary protrusions smaller in size than the protrusions of the protruding parts, rainwater on a wet umbrella is adsorbed efficiently, and at the same time, the protruding parts are stably maintained in a shape protruding toward a dewatering space by mutual support of the numerous protrusions and the numerous auxiliary protrusions.

Still another objective of the present invention is to provide an umbrella water removing apparatus, wherein by providing a dewatering space having a tapered shape in which an upper side is wider than a lower side, the contact area between a wet umbrella and a detachable pad is increased, and at the same time, the wet umbrella efficiently passes through the detachable pad.

Still another objective of the present invention is to provide an umbrella water removing apparatus, wherein by providing a guide member, the problem that a large amount of rainwater falls onto the areas in front of and behind the umbrella water removing apparatus is solved.

Still another objective of the present invention is to provide an umbrella water removing apparatus, wherein by providing a reinforcement member inside a protruding part, elasticity of the protruding part is continuously maintained and thus rainwater on a wet umbrella is removed efficiently.

According to one aspect of the present invention, there is provided an umbrella water removing apparatus that collects and drains rainwater on a wet umbrella, the apparatus including: a supporting part; plate-shaped first and second dewatering parts provided on an upper surface of the supporting part at positions spaced apart from each other at a regular interval; a detachable pad attached and fixed to an inner surface of each of the first and second dewatering parts; a dewatering space formed between the respective detachable pads fixed to the respective inner surfaces of the first and second dewatering parts; and a plurality of protruding parts protruding from each of the detachable pads toward the dewatering space along a vertical direction, wherein the protruding parts may increase friction with a wet umbrella that is moved through the dewatering space, and rainwater on the wet umbrella may be efficiently shaken off by vibration generated by the wet umbrella that passes through the protruding parts, and at the same time, rainwater adsorbed on the protruding parts may be efficiently shaken off by vibration of the protruding parts after the wet umbrella passes therethrough.

Each of the protruding parts may be formed in a shape extending from the detachable pad toward the dewatering space and then folded back to form two layers.

The detachable pad and each of the protruding parts may include numerous protrusions protruding toward the dewatering space, wherein each of the protrusions may include numerous auxiliary protrusions smaller than in size than the protrusions and protruding toward the dewatering space, whereby the protrusions may come into efficient contact with rainwater on the wet umbrella to thereby efficiently shake off the rainwater on the wet umbrella, and at the same time, the protruding parts may be stably maintained in a shape protruding toward the dewatering space by mutual support of the numerous protrusions and the numerous auxiliary protrusions.

The dewatering space may be formed in a tapered shape in which an upper side is wide and a lower side is narrow, whereby contact areas between the wet umbrella and the respective detachable pads may be increased, and at the same time, the wet umbrella may efficiently pass through the detachable pads.

The apparatus may further include: a guide member connected to lower portions of the first and second dewatering parts to block a lower portion of the dewatering space.

The protruding parts may include a lower protruding part located at a lower position and an upper protruding part located at an upper position, wherein the lower protruding part may be formed to elongate in the vertical direction, the upper protruding part may be formed to be inclined with respect to the vertical direction, and opposed upper protruding parts may be arranged to cross each other.

The apparatus may further include: a reinforcement member inserted into the protruding part to increase elasticity of the protruding part.

The reinforcement member may be made of any one of silicon, plastic, and metal, and the reinforcement member may have an uneven portion formed on a side surface thereof so as to elongate in the vertical direction so that rainwater permeating into the protruding part flows down efficiently.

The protrusions and auxiliary protrusions may be made of polyester.

Advantageous Effects

According to the present invention, by providing protruding parts at a detachable pad, rainwater on an umbrella can be efficiently shaken off while the wet umbrella vibrates, and at the same time, rainwater adsorbed on the protruding parts can be efficiently shaken off and fall down by vibration of the protruding parts.

Furthermore, by providing numerous protrusions at protruding parts and by providing numerous auxiliary protrusions smaller in size than the protrusions of the protruding parts, rainwater on a wet umbrella can be adsorbed efficiently, and at the same time, the protruding parts can be maintained in a shape protruding toward a dewatering space by mutual support of the numerous protrusions and the numerous auxiliary protrusions.

Furthermore, by providing a dewatering space having a tapered shape in which an upper side is wider than a lower side, the contact area between a wet umbrella and a detachable pad can be increased, and at the same time, the wet umbrella can efficiently pass through the detachable pad.

Furthermore, by providing a guide member, the problem that a large amount of rainwater falls onto the areas in front of and behind the umbrella water removing apparatus can be solved.

Furthermore, by providing a reinforcement member inside a protruding part, elasticity of the protruding part can be continuously maintained and thus rainwater on a wet umbrella can be removed efficiently.

DETAILED DESCRIPTION OF THE INVENTION

Figure 1:
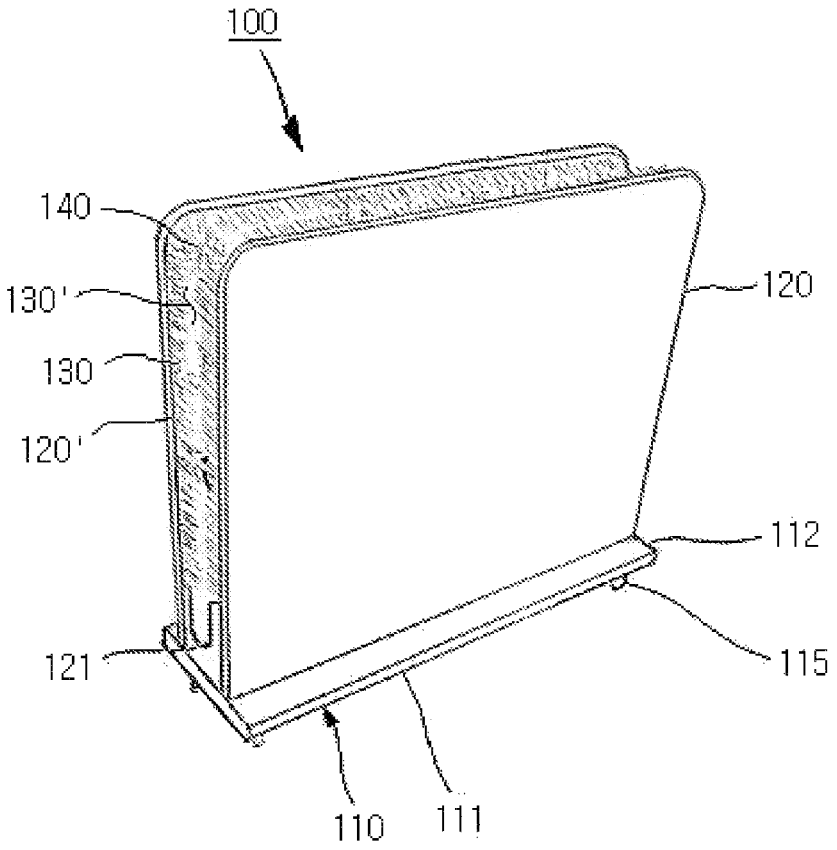
FIG. 1 is a perspective view illustrating an umbrella water removing apparatus according to the present invention.

Hereinafter, exemplary embodiments of the present invention will be described in detail with reference to exemplary drawings. As for reference numerals associated with parts in the drawings, the same reference numerals will refer to the same or like parts through the drawings. Further, in the following description, if it is decided that the detailed description of known function or configuration related to the invention makes the subject matter of the invention unclear, the detailed description is omitted.

Further, when describing the components of the present invention, terms such as first, second, A, B, (a) or (b) may be used. Since these terms are provided merely for the purpose of distinguishing the components from each other, they do not limit the nature, sequence, or order of the components. It will be understood that when an element is referred to as being "coupled" or "connected" to another element, it can be directly coupled or connected to the other element or intervening elements may be present therebetween.

Figure 2:
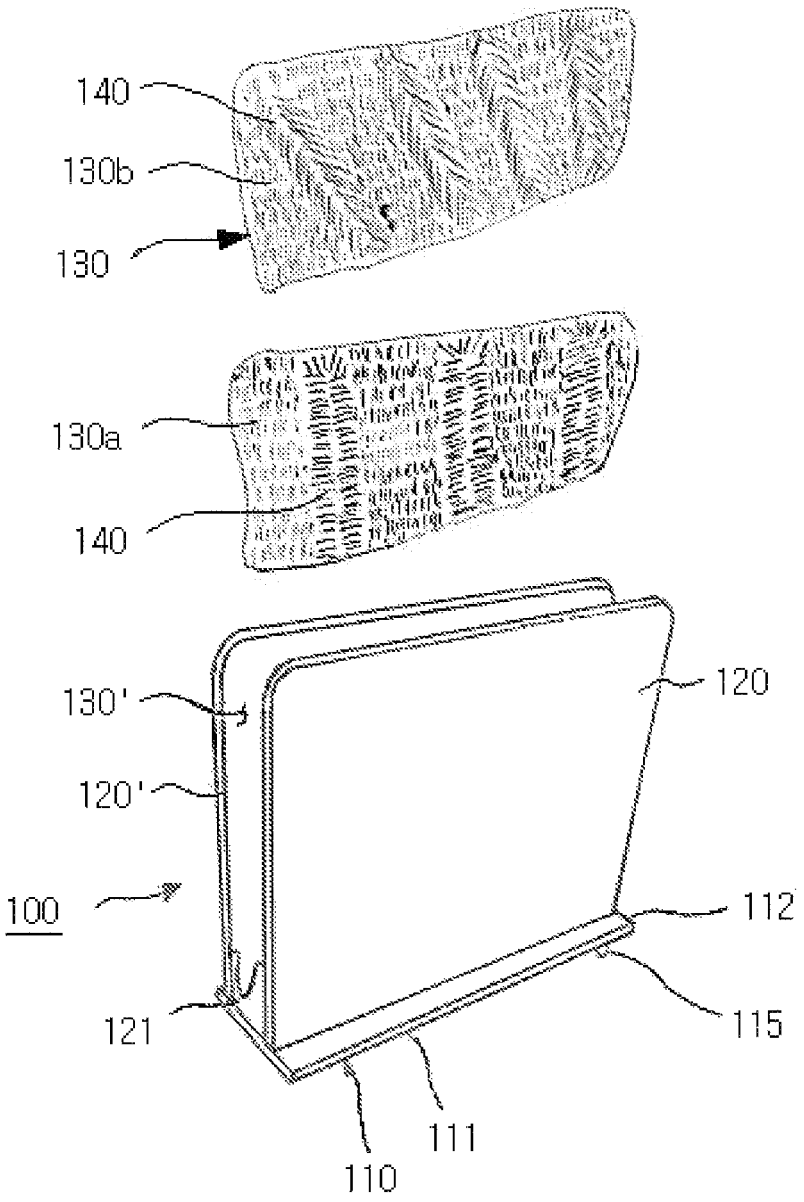
FIG. 2 is an exploded perspective view illustrating the umbrella water removing apparatus according to the present invention.
Figure 3:
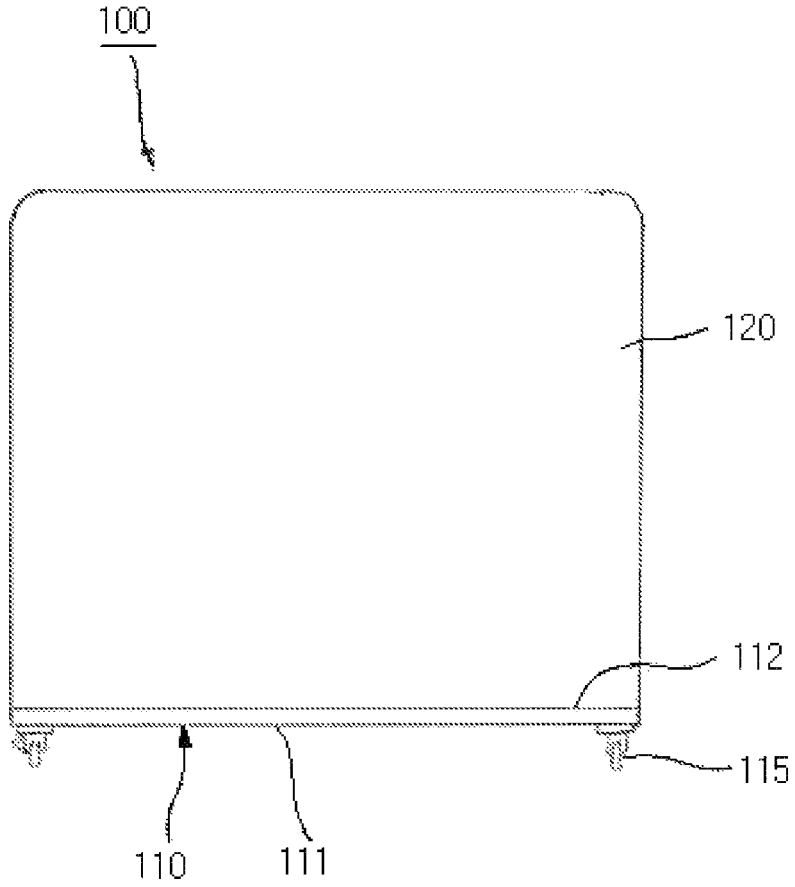
FIG. 3 is a front view illustrating a configuration of the umbrella water removing apparatus according to the present invention.
Figure 4:
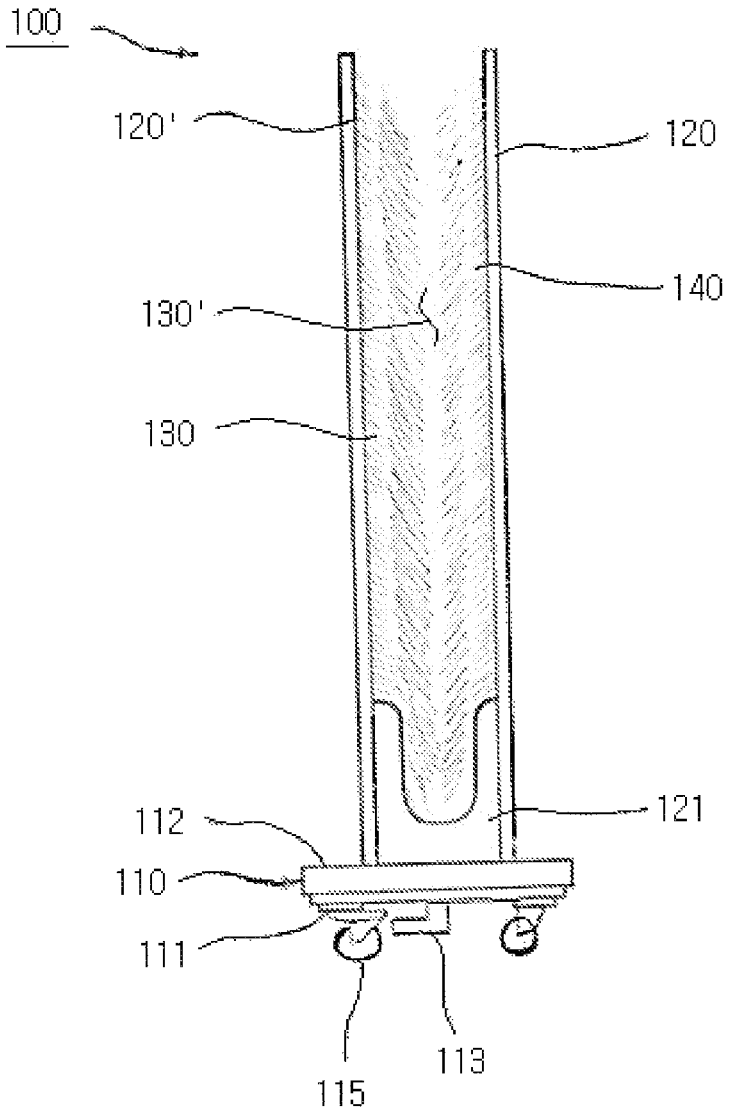
FIG. 4 is a side view illustrating a configuration of the umbrella water removing apparatus according to the present invention.
Figure 5:
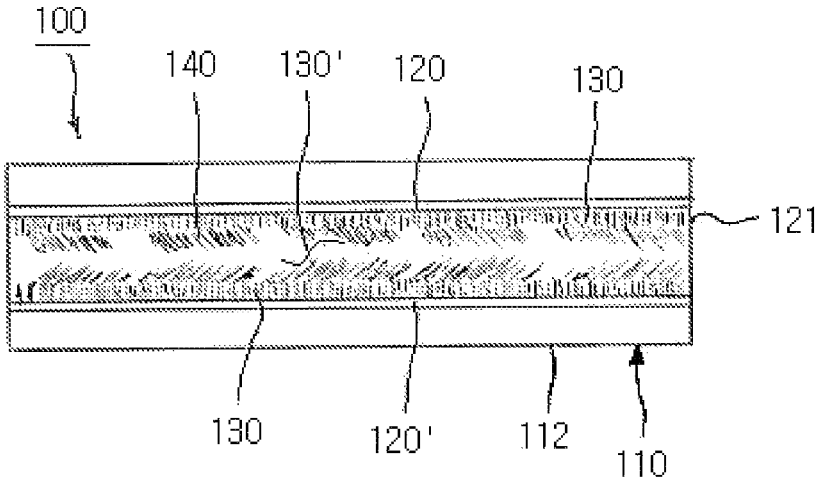
FIG. 5 is a plan view illustrating a configuration of the umbrella water removing apparatus according to the present invention.
Figure 6:
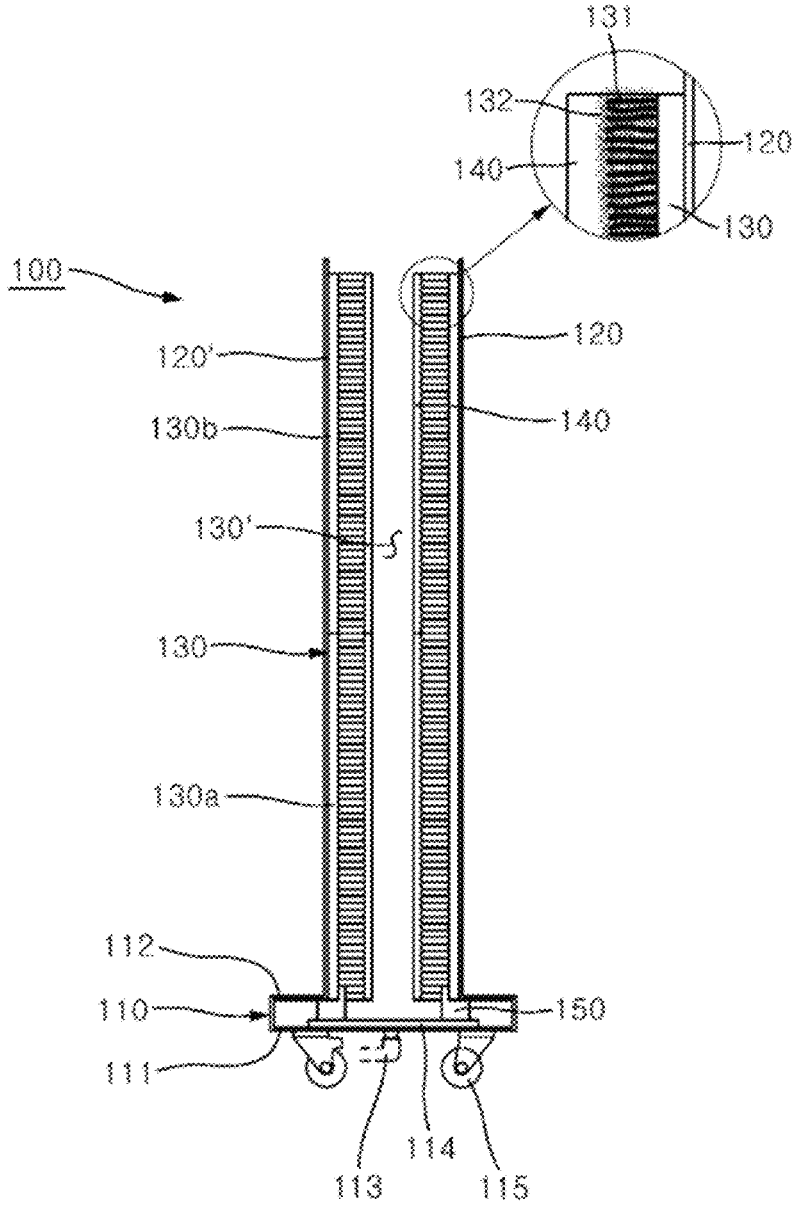
FIG. 6 is a side sectional view illustrating a configuration of the umbrella water removing apparatus according to the present invention.

FIG. 1 is a perspective view illustrating an umbrella water removing apparatus according to the present invention, FIG. 2 is an exploded perspective view illustrating the umbrella water removing apparatus according to the present invention, FIG. 3 is a front view illustrating a configuration of the umbrella water removing apparatus according to the present invention, FIG. is a side view illustrating a configuration of the umbrella water removing apparatus according to the present invention, FIG. 5 is a plan view illustrating a configuration of the umbrella water removing apparatus according to the present invention, and FIG. 6 is a side sectional view illustrating a configuration of the umbrella water removing apparatus according to the present invention.

An umbrella water removing apparatus 100 according to an embodiment of the present invention is configured to collect and drain rainwater on a wet umbrella 10 and may include a supporting part 110, a first dewatering part 120, a second dewatering part 120', a detachable pad 130, and a protruding part 140.

The supporting part 110 may collect and drain rainwater falling from the wet umbrella 10 and supporting part the first dewatering part 120 and the second dewatering part 120'. The supporting part 110 may include a lower plate 111, an upper plate 112, and a drain pipe 113. The drain pipe 113 may be provided with a valve. The valve may allow rainwater to be temporarily stored in the supporting part 110 and may be opened when necessary to allow the rainwater to be drained.

The lower plate 111 may be formed in a plate shape. The upper plate 112 may be provided above the lower plate 111 to support the first and second dewatering parts 120 and 120'. The upper plate 112 and the lower plate 111 may be located spaced apart from each other at a predetermined interval to form a space therebetween in which rainwater is stored. A gap defined between the plates 112 and 111 may be provided with side plates arranged along the perimeter thereof. The upper plate 112 and the side plates may be formed integrally with the lower plate 111 by being bent at the lower plate 111.

The drain pipe 113 may be installed in a hole (not illustrated) formed through the lower plate 111, to drain rainwater falling from the wet umbrella 10. The hole (not illustrated) may be formed at the center or edge of the lower plate 111. The lower plate 111 may be formed to be inclined at a predetermined angle in the direction of the hole (not illustrated) so that rainwater can be drained efficiently.

A cushion part 114 made of a material having a predetermined thickness and absorbing moisture may be installed on an upper surface of the lower plate 111. The cushion part 114 may temporarily absorb rainwater falling from the wet umbrella 10 to prevent excessive rainwater drainage.

Wheels 115 for the convenience of movement of the umbrella water removing apparatus 100 may be installed on a lower surface of the lower plate 111.

The first dewatering part 120 and the second dewatering part 120' may be provided perpendicular to the upper plate 112. The detachable pad 130 may be attached and fixed to an inner surface of each of the first dewatering part 120 and the second dewatering part 120'. The respective detachable pads 130 may be attached and fixed to the first dewatering part 120 and the second dewatering part 120' by means of magnetic force. To this end, a magnet may be attached to each of the detachable pads 130. In another embodiment, a magnet may be embedded in the detachable pad 130, or a magnetic material may be included in the detachable pad 130.

A guide member 121 may be provided between opposed lower portions of the first dewatering part 120 and the second dewatering part 120'. The guide member 121 may block a lower portion of a dewatering space 130'. The guide member 121 may be coupled to the lower portions of the first dewatering part 120 and the second dewatering part 120'. The guide member 121 may block the lower portions of the first dewatering part 120 and the second dewatering part 120', thereby forming a larger storage space for rainwater. A concave mouth for guiding the movement of the wet umbrella 10 may be formed at an upper portion of the guide member 121.

Figure 7:
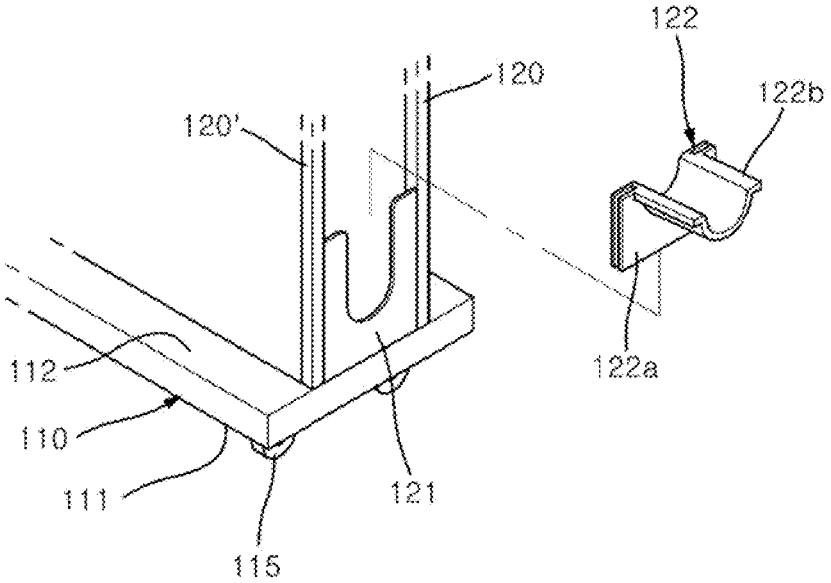
FIG. 7 is an exploded perspective view illustrating a rainwater guide member is applied to the umbrella water removing apparatus according to the present invention.

As illustrated in FIG. 7, a rainwater guide member 122 detachably mounted to the guide member 121 may be further provided. The rainwater guide member 122 may guide rainwater falling from the wet umbrella 10, which is inserted into the dewatering space 130' or removed from the dewatering space 130', to the support 110.

The rainwater guide member 122 may include a locking portion 122*a* and a guide portion 122*b*. The locking portion 122*a* may include an inner plate and an outer plate that come into close contact with an inner side and an outer side of the guide member 121, respectively, and may be detachably locked to the guide member 121. The guide portion 122*b* may extend from the locking portion 122*a* to be inclined upwardly outwardly, and may guide rainwater falling from the umbrella 10, which approaches or leaves the umbrella water removing apparatus, to the supporting part 110. The guide portion 122*b* may be formed in a U-shape or a V-shape.

The rainwater guide member 122 may be removed from the umbrella water removing apparatus when not necessary. Alternatively, when not in use, the rainwater guide member 122 may be detached from the guide member 121 and mounted thereto such that the guide portion 122*b* faces the inside of the umbrella water removing apparatus, whereby the rainwater guide member 122 can be stored efficiently.

The detachable pads 130 may be attached and fixed to the inner surfaces of the first dewatering part 120 and the second dewatering part 120 to adsorb rainwater on the wet umbrella 10. The detachable pads 130 may be made of a material, such as fabric, that can absorb water.

The dewatering space 130' may be formed between the detachable pads 130 attached and fixed to the first dewatering part 120 and the second dewatering part 120'.

The dewatering space 130' may allow the wet umbrella 10 to be moved therethrough. The dewatering space 130' may be formed in a tapered shape in which an upper side is wide and a lower side is narrow. This may increase the contact area between the wet umbrella 10 and the detachable pad 130 to efficiently remove rainwater, and at the same time, may allow the wet umbrella 10 to efficiently pass through the detachable pad 130. The dewatering space 130' having a tapered shape may be formed by forming the first and second dewatering parts 120 and 120' themselves inclined outwardly in opposite directions, or by forming inner surfaces thereof inclined outwardly in opposite directions.

Each of the detachable pads 130 may include a lower detachable pad 130*a* attached and fixed to a lower side of each of the first and second dewatering parts 120 and 120', and an upper detachable pad 130*b* attached and fixed to an upper side of each of the first and second dewatering parts 120 and 120'. The detachable pad 130 may be detachably attached and fixed to the inner surface of each of the first dewatering part 120 and the second dewatering part 120' by a configuration (not illustrated), such as Velcro tape, other than the aforementioned magnet.

Herein, it should be understood that the detachable pad 130 is divided into a plurality of detachable pads, i.e., the lower detachable pad 130*a* and the upper detachable pad 130*b*, depending on attachment positions on each of the first and second dewatering parts 120 and 120', and that the detachable pad 130 is detachably attached to each of the first and second dewatering parts 120 and 120'. However, a single detachable pad 130 may be attached and fixed to the inner surface of each of the first and second dewatering parts 120 and 120'.

The protruding part 140 may protrude from the detachable pad 130 and may be provided as a plurality of protruding parts 140 to increase friction with the wet umbrella 10 moved through the dewatering space 130'. When the wet umbrella 10 comes into contact and collides with the protruding parts 140, vibration may be generated to cause rainwater on the wet umbrella 10 to be shaken off and fall down or to efficiently be adsorbed onto the protruding parts 140. Furthermore, the protruding parts 140 may adsorb rainwater on the wet umbrella 10 that comes into contact therewith and passes therethrough, and cause the adsorbed rainwater to be shaken off and fall down by vibration generated as the wet umbrella 10 passes there through.

Each of the protruding parts 140 may be formed in a shape extending from the detachable pad 130 toward the dewatering space 130' and folded back to form two layers. For example, the protruding part 140 may be formed in such a manner that the detachable pad 130 is folded along fold lines and folded portions are sewn together. Furthermore, such a two-layer configuration may have an appropriate supporting force, thereby allowing the protruding part 140 to be stably maintained in a shape protruding toward the dewatering space 130' by the supporting force. This can make it possible for the protruding part 140 to come into efficient contact with the wet umbrella 10, and to cause the wet umbrella 10 to vibrate so that rainwater on the wet umbrella 10 can be shaken off by vibration. At the same time, the protruding part 140 itself also vibrates while the wet umbrella 10 passes therethrough, thereby causing rainwater adsorbed on the protruding part 140 to be shaken off and fall down. This can facilitate adsorption and removal of rainwater on the wet umbrella 10 that repeatedly passes through the protruding part 140.

The detachable pad 130 and the protruding part 140 may be respectively provided with a plurality of numerous protrusions 131 and 141 protruding toward the dewatering space 130'. Each of the protrusions 131 and 141 may be configured such that the inside thereof has a hollow structure in which an elastic space is formed. This hollow structure may serve to reduce the weight of the protrusions 131 and 141 so that they have elasticity, and to prevent the protrusions 131 and 141 from sagging due to their own weight. Therefore, the protrusions 131 and 141 can come into efficient contact with the wet umbrella 10 to thereby efficiently remove rainwater on the wet umbrella 10.

The protrusions 131 and 141 may respectively have small, fine, and numerous auxiliary protrusions 132 and 142 protruding toward the dewatering space 130'. By mutual support of the numerous protrusions 131 and 141 and the fine and numerous auxiliary protrusions 132 and 142 formed on the protrusions 131 and 141, the protruding part 140 can be stably maintained in a shape protruding toward the dewatering space 130'. The protruding part 140 stably maintained in a shape protruding toward the dewatering space 130' can efficiently adsorb and remove rainwater on the wet umbrella 10 that passes through the protruding part 140 repeatedly.

The protrusions 131 and 141 and the auxiliary protrusions 132 and 142 may be made of polyester. The detachable pad 130 and the protruding part 140 may also be made of polyester. The polyester is a material that does not change in strength even when wet with water and has high durability, and thus it is possible to prevent deformation of the detachable pad 130 and the protruding part 140, while maintaining the shape thereof.

The protruding parts 140 may be formed to elongate in the vertical direction and may be located at positions corresponding to each other or staggered with each other on the detachable pads 130 opposed to each other. The protruding parts 140 located to correspond to each other or staggered with each other may vibrate the wet umbrella 10 passing therethrough, thereby adsorbing rainwater on the wet umbrella 10 or causing the rainwater to be shaken off and fall down. Furthermore, the protruding parts 140 may vibrate themselves after the wet umbrella 10 passes therethrough, thereby causing the adsorbed rainwater to be shaken off and fall or flow down.

The protruding parts 140 may include a lower protruding part located at a lower position and an upper protruding part located at an upper position. The lower protruding part may be formed to elongate in the vertical direction, and the upper protruding part may be formed to be inclined at a predetermined angle with respect to the vertical direction. Furthermore, opposed upper protruding parts formed to be inclined may be arranged to cross each other. The upper protruding parts arranged in crossed relationship with each other may have increased friction with the wet umbrella 10 moved in the opposite directions to thereby effectively adsorb rainwater on the wet umbrella 10 or cause the rainwater to be shaken off. The lower protruding parts formed in the vertical direction may cause the adsorbed rainwater or rainwater flowing from above to efficiently flow down.

Figure 8:
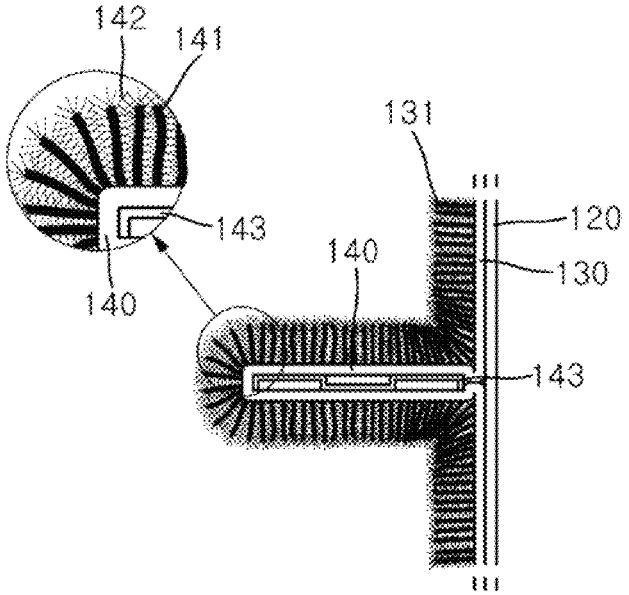
FIG. 8 is a plan sectional view illustrating a configuration of a reinforcement member as an example of the umbrella water removing apparatus according to the present invention.
Figure 9:
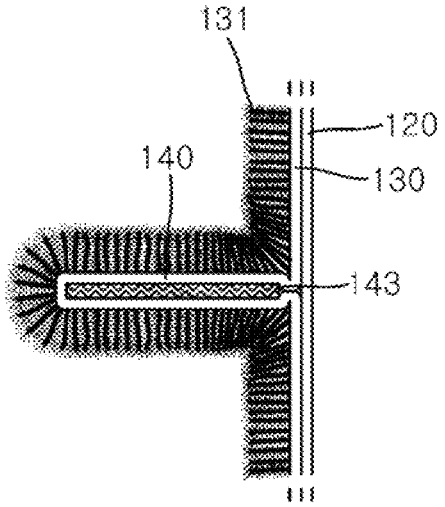
FIG. 9 is a plan sectional view illustrating a configuration of a reinforcement member as another example of the umbrella water removing apparatus according to the present invention.

As illustrated in FIGS. 8 to 9, a reinforcement member 143 may be further provided in each of the protruding parts 140 to increase elasticity of the protruding part 140. The reinforcement member 143 may be made of any one of silicon, plastic, and a rust-resistant metal. The reinforcement member 143 may have an uneven portion formed on a side surface thereof to provide flexibility and elasticity to the reinforcement member 143. Accordingly, when the wet umbrella 10 passes through the protruding part 140, the reinforcement member 143 may be flexibly bent and then return to an original position thereof by elasticity to standby for the next operation.

The uneven portion may be configured such that a concave portion and a convex portion are formed in an alternate manner and may guide rainwater that permeates into the protruding part 140 to flow down toward the supporting part 110.

Figure 10:
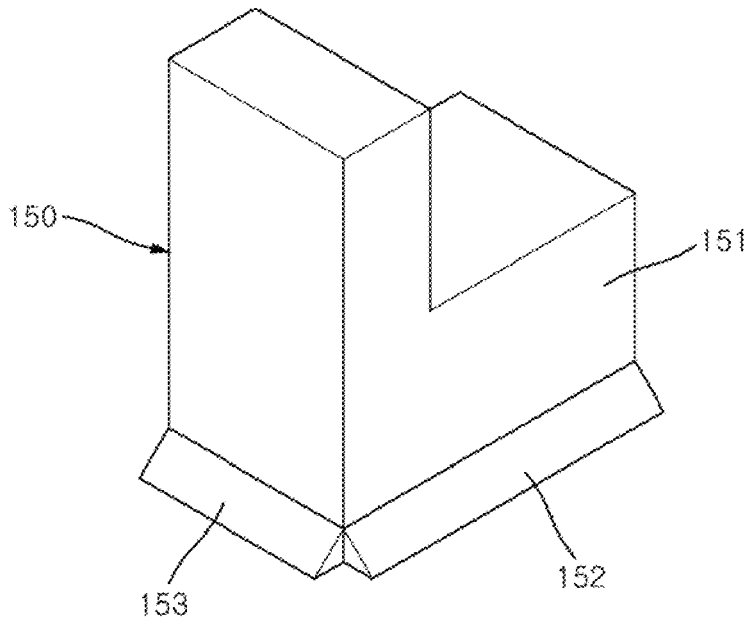
FIG. 10 is a perspective view illustrating an anti-sagging part of the umbrella water removing apparatus according to the present invention.

As illustrated in FIG. 10, the umbrella water removing apparatus 100 may further include an anti-sagging part 150 supporting each of the detachable pads 130 to prevent sagging of the detachable pad 130. The anti-sagging part 150 may include a supporting body 151, an anti-separation supporting member 152, and an anti-slip supporting member 153.

The supporting body 151 may be formed in a block shape to support the detachable pad 130.

The anti-separation supporting member 152 may inclinedly protrude from one side surface of the supporting body 151 and may be stuck in the cushion part 114 placed on the upper surface of the lower plate 111, to thereby effectively prevent the supporting body 151 from being moved to a central portion of the lower plate 111 and separated.

The anti-slip supporting member 153 may inclinedly protrude from one side surface of the supporting body 151 so as to be perpendicular to the anti-separation supporting member 152 and may be stuck in the cushion part 114 while pressurizing the cushion part 114 placed on the upper surface of the lower plate 111, to thereby effectively prevent the supporting body 151 from slipping.

The following will describe the manufacture and use process of the umbrella water removing apparatus 100.

First, the upper plate 112 may be formed above the lower plate 111 of a plate shape having a predetermined size. The upper plate 112 may be formed integrally with the lower plate 111 by being bent at the lower plate 111. The drain pipe 113 may be mounted to the hole passing through the lower plate 111. The wheels 115 may be mounted to the lower surface of the lower plate 111. The cushion part 114 may be mounted to the upper surface of the lower plate 111.

The plate-shaped first and second dewatering parts 120 and 120' may be fixed to the upper plate 112. The first dewatering part 120 and the second dewatering part 120' may be formed integrally with the upper plate 112 by being bent at the end thereof depending on a design drawing.

The guide member 121 may be coupled to the opposed lower portions of the first dewatering part 120 and the second dewatering part 120'. Accordingly, the guide member 121 may be connected to the first dewatering part 120, the second dewatering part 120', and the supporting part 110, thereby forming a space for storing rainwater inside the supporting part 110.

The rainwater guide member 122 may be selectively mounted to the guide member 121. The rainwater guide member 122 may be fitted and fixed to the guide member 121 such that the inner plate and the outer plate of the locking portion 122*a* of the rainwater guide member 122 come into surface contact with the inner side and the outer side of the guide member 121, respectively. The guide portion 122*b* may be formed by extending from the locking portion 122*a* to be inclined upwardly outwardly. The guide portion 122*b* may guide rainwater falling from the wet umbrella 10 that is inserted into or removed from the dewatering space 130' to the supporting part 110, thereby minimize the amount of rainwater falling onto the indoor floor to minimize contamination of the indoor floor.

The dewatering space 130' may be formed in a tapered shape in which an upper side is wide and a lower side is narrow. This can make it possible to increase the contact area between the wet umbrella 10 and the detachable pads 130 and the protruding parts 140 to increase friction. To this end, the first dewatering part 120 and the second dewatering part 120' to each of which each of the detachable pads 130 is attached may be inclinedly formed, thereby forming a dewatering space 130' having a tapered shape.

The detachable pad 130 may be attached and fixed to the inner surface of each of the first dewatering part 120 and the second dewatering part 120' by an attachment member (not illustrated). The attachment member (not illustrated) may be a magnet embedded in the detachable pad 130 or a Velcro tape. The magnet may be embedded in each of the first dewatering part 120 and the second dewatering part 120'.

The reinforcement member 143 formed in an uneven shape may be embedded in each of the protruding parts 140. Each of the detachable pad 130*s* may be supported by the supporting body 151 of the anti-sagging part 150. A lower surface of the supporting body 151 may be placed on the cushion part 114 and an upper surface of the supporting body 151 may come into close contact with a lower surface of the detachable pad 130, whereby the manufacture of the umbrella water removing apparatus 100 according to the present invention may be completed while preventing the sagging of the detachable pad 130.

When the supporting body 151 is pushed and moved toward each side of each of the first dewatering part 120 and the second dewatering part 120', i.e., in the direction of the guide member 121, in the state in which the supporting body 151 of the anti-sagging part 150 is placed on the lower surface of the detachable pad 130, the anti-separation supporting member 152 inclinedly protruding from one side surface of the supporting body 151 may be stuck in and fixed to the cushion part 114, thereby effectively preventing the supporting body 151 from being moved toward the central portion of the lower plate 111 and separated. At the same time, the anti-slip supporting member 153 inclinedly protruding from one side surface of the supporting body 151 so as to be perpendicular to the anti-separation supporting member 152 may be stuck in the cushion part 114, thereby effectively preventing the supporting body 151 from slipping.

Figure 11:
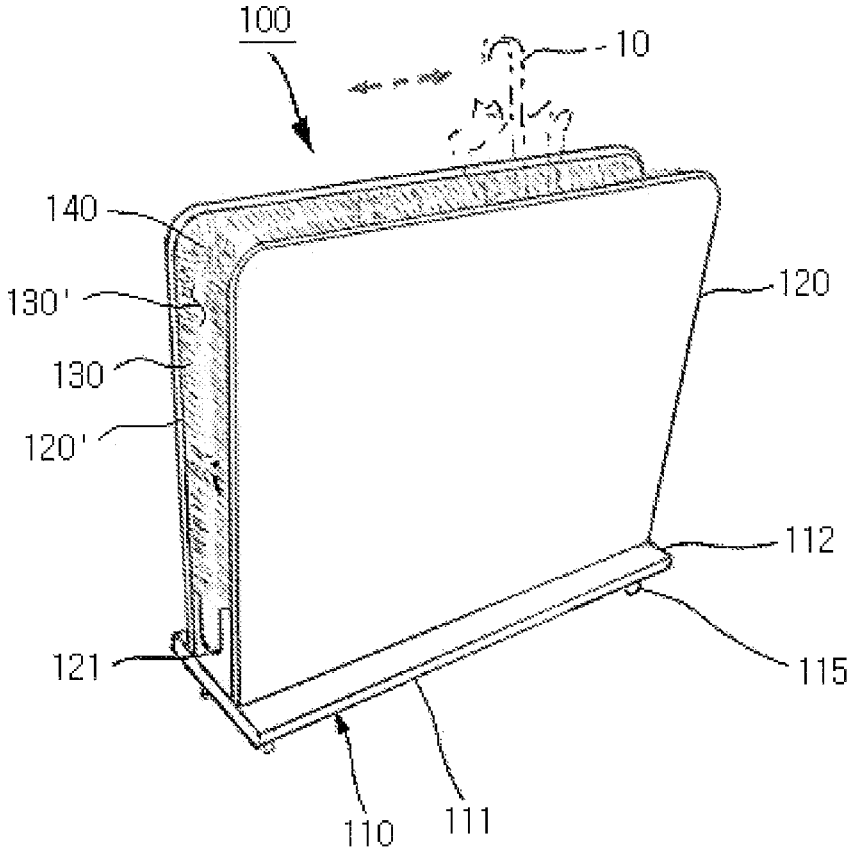
FIG. 11 is a view illustrating a use state of the umbrella water removing apparatus according to the present invention.

In the state in which the umbrella water removing apparatus 100 manufactured by the above process is placed at the entrance of a building on rainy days, as illustrated in FIG. 11, the wet umbrella 10 with rain water may be inserted into the dewatering space 130' and moved therethrough in opposite directions several times.

Rainwater falling from the wet umbrella 10 may be guided to the space of the supporting part 110 along the guide portion 122*b* while the wet umbrella 10 is moved to above the guide portion 122*b* of the rainwater guide member 122 protruding from the end of the dewatering space 130'. This can make it possible to reduce the amount of rainwater falling from the wet umbrella 10 onto the indoor floor, thereby lowering the pollution level of the indoor floor.

The wet umbrella 10 inserted into the dewatering space 130' through the rainwater guide member 122 may be repeatedly moved through the dewatering space 130' in opposite directions from one side to the other side or from the other side to the one side. Alternatively, the wet umbrella 10 may be moved while being rotated.

Since the dewatering space 130' having a tapered shape in which the upper side is wide and the lower side is narrow, this can maximize the contact area between an outer surface of the wet umbrella 10 moved through the dewatering space 130' and the respective pluralities of protrusions 131 of the detachable pads 130 attached to the first dewatering part 120 and the second dewatering part 120', and the wet umbrella 10 may be moved while sequentially coming into contact with the pluralities of protrusions 131.

While the wet umbrella 10 is moved through the dewatering space 130' from onside to the other side or from the other side to one side, the wet umbrella 10 may come into sequential contact with the pluralities of protrusions 131 of the detachable pads 130 and rainwater on the wet umbrella 10 may be shaken off by friction, elasticity, and the like and fall down toward the lower plate 111.

Furthermore, while the wet umbrella 10 is moved from one side of the dewatering space 130' to the other side or from the other side to one side, the wet umbrella may pass through the protruding parts 140 formed inclinedly or vertically at positions corresponding to each other or staggered with each other. At this time, due to the difference in the force applied to the wet umbrella 10 while the wet umbrella 10 is moved through the area where the protruding parts 140 are provided and the area where no protruding parts 140 are provided, vibration may be generated while the wet umbrella 10 passes through the protruding parts 140, and rainwater on the wet umbrella 10 can be efficiently shaken off and fall down by this vibration.

Furthermore, the wet umbrella 10 may be sequentially repeatedly moved through the area where the protruding parts 140 are provided and the area where no protruding parts 140 are provided, i.e., between the detachable pads 130, thereby effectively removing rainwater on the wet umbrella 10 to increase rainwater removal efficiency. At this time, while the wet umbrella 10 comes into contact with the respective pluralities of protrusions 141 protruding from the protruding parts 140, rainwater on the umbrella 10 may be shaken off by friction, elasticity, and the like and fall down toward the lower plate 111.

Since each of the protruding parts 140 has the uneven-shaped reinforcement member 143, when the wet umbrella 10 is moved through the dewatering space 130' while pressurizing the protruding parts 140, the protruding parts 140 may be flexibly bent, and when the wet umbrella 10 passes through the protruding parts 140 and the pressure of the wet umbrella 10 acting thereon is released, the protruding parts 140 may return to original positions thereof by elasticity of the respective reinforcement members 143 and standby for the next operation.

Furthermore, a part of the rainwater shaken off the wet umbrella 10 may fall down toward the supporting part 110 to be stored therein, and a remaining part of the rainwater may be retained in the protruding parts 140, and a part of the rainwater retained in the protruding parts 140 may flow down along the respective uneven portions of the reinforcement members 143 provided in the protruding parts 140 toward the supporting part 110.

Here, since the numerous auxiliary protrusions 132 and 142 that are smaller in size than the protrusions 131 and 141 are provided at the protrusions 131 of the detachable pads 130 and the protrusions 141 of the protruding parts 140, this can enable the protrusions 131 and 141 to come into efficient contact with rainwater on the wet umbrella 10 to thereby efficiently shake off the rainwater on the wet umbrella 10. At the same time, by mutual support of the numerous protrusions 131 and 141 and the numerous auxiliary protrusions 132 and 142, the protruding parts 140 can be stably maintained in a shape protruding toward the dewatering space 130'.

The rainwater falling down toward the lower plate 111 and stored in the space of the supporting part 110 may be discharged through the drain pipe 113 by opening of the valve. Alternatively, when the valve is not installed at the drain pipe 113, rainwater falling into the space may be directly discharged through the drain pipe 113. In this case, an upper surface of the lower plate 111 at which the drain pipe 113 is installed, i.e., the bottom of the umbrella water removing apparatus, may be formed to be inclined so that rainwater can flow toward the drain pipe 113, thereby facilitating drainage of rainwater.

The umbrella water removing apparatus 100 can be replaced and used depending on the amount of rain on the detachable pads 130, and when the use of the umbrella water removing apparatus 100 is completed, if necessary, the detachable pads 130 may be detached from the first dewatering part 120 and the second dewatering part 120' and dried and then attached again and stored.

Furthermore, the rainwater guide member 122 may be removed from the guide member 121 and stored separately when not necessary. Alternatively, the locking portion 122*b* may be mounted to the guide member 121 such that the guide portion 122*b* of the rainwater guide member 122 is located in the dewatering space 130' and stored to standby for the next operation.

Even though all the elements of the embodiments are coupled into one or operated in the combined state, the present disclosure is not limited to such an embodiment. That is, all the elements may be selectively combined with each other without departing from the scope of the invention. It will be further understood that the terms "comprise", "include", "have", etc. when used herein, specify the presence of stated features, integers, steps, operations, elements, components, and/or combinations of them but do not preclude the presence or addition of one or more other features, integers, steps, operations, elements, components, and/or combinations thereof. Unless otherwise defined, all terms including technical and scientific terms used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

While the exemplary embodiments of the invention have been described above, the embodiments are only examples of the invention, and it will be understood by those skilled in the art that the invention can be modified in various forms without departing from the technical spirit of the invention. Therefore, the embodiments of the present invention are disclosed only for illustrative purposes and should not be construed as limiting the technical scope of the present invention. Therefore, the scope of the invention should be determined on the basis of the descriptions in the appended claims, not any specific embodiment, and all equivalents thereof should belong to the scope of the invention.

What is claimed is:

1. An umbrella water removing apparatus for collecting and draining rainwater on a wet umbrella, the umbrella water removing apparatus comprising:

a supporting part;

plate-shaped first and second dewatering parts provided on an upper surface of the supporting part at positions spaced apart from each other at a regular interval;

a detachable pad attached and fixed to an inner surface of each of the first and second dewatering parts;

a dewatering space formed between the respective detachable pads fixed to the respective inner surfaces of the first and second dewatering parts; and a plurality of protruding parts protruding from each of the detachable pads toward the dewatering space along a vertical direction, wherein the protruding parts increase friction with a wet umbrella that is moved through the dewatering space, and rainwater on the wet umbrella is efficiently shaken off by vibration generated by the wet umbrella that passes through the protruding parts, and at the same time, rainwater adsorbed on the protruding parts is efficiently shaken off by vibration of the protruding parts after the wet umbrella passes therethrough, wherein the detachable pad and each of the protruding parts includes numerous protrusions protruding toward the dewatering space, wherein each of the protrusions includes numerous auxiliary protrusions smaller than in size than the protrusions and protruding toward the dewatering space, whereby the protrusions come into efficient contact with rainwater on the wet umbrella to thereby efficiently shake off the rainwater on the wet umbrella, and at the same time, the protruding parts are stably maintained in a shape protruding toward the dewatering space by mutual support of the numerous protrusions and the numerous auxiliary protrusions.

2. The umbrella water removing apparatus of claim 1, wherein each of the protruding parts is formed in a shape extending from the detachable pad toward the dewatering space and then folded back to form two layers.

3. The umbrella water removing apparatus of claim 1, wherein the dewatering space is formed in a tapered shape in which an upper side is wide and a lower side is narrow, whereby contact areas between the wet umbrella and the respective detachable pads are increased, and at the same time, the wet umbrella efficiently passes through the detachable pads.

4. The umbrella water removing apparatus of claim 1, further comprising:

a guide member connected to lower portions of the first and second dewatering parts to block a lower portion of the dewatering space.

5. The umbrella water removing apparatus of claim 1, further comprising:

a reinforcement member inserted into the protruding part to increase elasticity of the protruding part.

6. The umbrella water removing apparatus of claim 5, wherein:

the reinforcement member is made of any one of silicon, plastic, and metal, and the reinforcement member has an uneven portion formed on a side surface thereof so as to elongate in the vertical direction so that rainwater permeating into the protruding part flows down efficiently.

7. The umbrella water removing apparatus of claim 1, wherein the protrusions and auxiliary protrusions are made of polyester.

8. An umbrella water removing apparatus for collecting and draining rainwater on a wet umbrella, the umbrella water removing apparatus comprising:

a supporting part;

plate-shaped first and second dewatering parts provided on an upper surface of the supporting part at positions spaced apart from each other at a regular interval;

a detachable pad attached and fixed to an inner surface of each of the first and second dewatering parts;

a dewatering space formed between the respective detachable pads fixed to the respective inner surfaces of the first and second dewatering parts; and a plurality of protruding parts protruding from each of the detachable pads toward the dewatering space along a vertical direction, wherein the protruding parts increase friction with a wet umbrella that is moved through the dewatering space, and rainwater on the wet umbrella is efficiently shaken off by vibration generated by the wet umbrella that passes through the protruding parts, and at the same time, rainwater adsorbed on the protruding parts is efficiently shaken off by vibration of the protruding parts after the wet umbrella passes therethrough, wherein the protruding parts include a lower protruding part located at a lower position and an upper protruding part located at an upper position, wherein the lower protruding part is formed to elongate in the vertical direction, the upper protruding part is formed to be inclined with respect to the vertical direction, and opposed upper protruding parts are arranged to cross each other.

9. The umbrella water removing apparatus of claim 8, wherein each of the protruding parts is formed in a shape extending from the detachable pad toward the dewatering space and then folded back to form two layers.

10. The umbrella water removing apparatus of claim 8, wherein the dewatering space is formed in a tapered shape in which an upper side is wide and a lower side is narrow, whereby contact areas between the wet umbrella and the respective detachable pads are increased, and at the same time, the wet umbrella efficiently passes through the detachable pads.

11. The umbrella water removing apparatus of claim 8, further comprising:

a guide member connected to lower portions of the first and second dewatering parts to block a lower portion of the dewatering space.

12. The umbrella water removing apparatus of claim 8, further comprising:

a reinforcement member inserted into the protruding part to increase elasticity of the protruding part.

13. The umbrella water removing apparatus of claim 12, wherein:

the reinforcement member is made of any one of silicon, plastic, and metal, and the reinforcement member has an uneven portion formed on a side surface thereof so as to elongate in the vertical direction so that rainwater permeating into the protruding part flows down efficiently.

14. An umbrella water removing apparatus for collecting and draining rainwater on a wet umbrella, the umbrella water removing apparatus comprising:

a supporting part;

plate-shaped first and second dewatering parts provided on an upper surface of the supporting part at positions spaced apart from each other at a regular interval;

a detachable pad attached and fixed to an inner surface of each of the first and second dewatering parts;

a dewatering space formed between the respective detachable pads fixed to the respective inner surfaces of the first and second dewatering parts;

a plurality of protruding parts protruding from each of the detachable pads toward the dewatering space along a vertical direction; and a reinforcement member inserted into the protruding part to increase elasticity of the protruding part, wherein the protruding parts increase friction with a wet umbrella that is moved through the dewatering space, and rainwater on the wet umbrella is efficiently shaken off by vibration generated by the wet umbrella that passes through the protruding parts, and at the same time, rainwater adsorbed on the protruding parts is efficiently shaken off by vibration of the protruding parts after the wet umbrella passes therethrough, wherein each of the protruding parts is formed in a shape extending from the detachable pad toward the dewatering space and then folded back to form two layers, wherein the reinforcement member is made of any one of silicon, plastic, and metal, and the reinforcement member has an uneven portion formed on a side surface thereof so as to elongate in the vertical direction so that rainwater permeating into the protruding part flows down efficiently.

* * * * *